US011719106B2

(12) United States Patent
Yeh et al.

(10) Patent No.: US 11,719,106 B2
(45) Date of Patent: Aug. 8, 2023

(54) FAN

(71) Applicant: Delta Electronics, Inc., Taoyuan (TW)

(72) Inventors: Ching-Hsien Yeh, Taoyuan (TW); Chih-Wei Chan, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 17/881,504

(22) Filed: Aug. 4, 2022

(65) Prior Publication Data

US 2022/0372883 A1 Nov. 24, 2022

Related U.S. Application Data

(62) Division of application No. 16/734,204, filed on Jan. 3, 2020, now Pat. No. 11,441,433.

(30) Foreign Application Priority Data

May 10, 2019 (CN) ..... 201910391631.3

(51) Int. Cl.
*F04D 29/32* (2006.01)
*F01D 5/30* (2006.01)

(52) U.S. Cl.
CPC ..... *F01D 5/3061* (2013.01); *F04D 29/325* (2013.01)

(58) Field of Classification Search
CPC .... F04D 5/3061; F04D 29/325; F04D 29/626; F04D 29/281; F04D 29/666
See application file for complete search history.

(56) References Cited

U.S. PATENT DOCUMENTS

| | | | | |
|---|---|---|---|---|
| 8,382,437 | B2 | 2/2013 | Tao et al. | |
| 10,100,840 | B2 * | 10/2018 | Xu | F04D 29/626 |
| 10,480,525 | B2 * | 11/2019 | Xu | F04D 29/30 |
| 2009/0175730 | A1 * | 7/2009 | Wu | F04D 29/329 416/223 R |
| 2015/0275922 | A1 | 10/2015 | Son | |

FOREIGN PATENT DOCUMENTS

| | | | | |
|---|---|---|---|---|
| CN | 1834470 | A | | 9/2006 |
| CN | 200958489 | Y | | 10/2007 |
| CN | 104033419 | A | | 9/2014 |
| CN | 204213045 | U | * | 3/2015 |
| CN | 204213045 | U | | 3/2015 |
| CN | 106949076 | A | | 7/2017 |
| CN | 107956738 | A | | 4/2018 |
| JP | H11264398 | A | | 9/1999 |
| TW | M372895 | U | | 1/2010 |
| TW | M402943 | U | | 5/2011 |
| TW | M536282 | U | | 2/2017 |
| TW | 597595 | B | | 9/2017 |
| TW | I612223 | B | | 1/2018 |

* cited by examiner

*Primary Examiner* — Sabbir Hasan
(74) *Attorney, Agent, or Firm* — Kirton McConkie; Evan R. Witt

(57) ABSTRACT

A fan includes a hub and a plurality of fan blades. The hub has an axle center. The fan blades are disposed around the hub. Each of the fan blades has a bent portion, and the bent portions of the fan blades are extended along a surrounding direction surrounding the axle center. The hub is welded with the bent portion of each of the fan blades along the surrounding direction. As a result, the number of fan blades is maximized, the strength is simultaneously ensured to be enough, and the advantages of effectively enhancing the fan characteristics are achieved.

10 Claims, 16 Drawing Sheets

FAN

CROSS-REFERENCE TO RELATED APPLICATION

This application is a divisional application of U.S. application Ser. No. 16/734,204 filed on Jan. 3, 2020 and entitled "FAN", which claims priority from China Patent Application No. 201910391631.3, filed on May 10, 2019. The entire contents of the above-mentioned patent applications are incorporated herein by reference for all purposes.

FIELD OF THE INVENTION

The present invention relates to a fan, and more particularly to a fan ensuring the quality, the characteristics and the lifetime.

BACKGROUND OF THE INVENTION

In recent years, with the increase in heat dissipation demand, the fan blade design has been developed toward the direction of high wind pressure and high wind volume. In general, in a conventional thin fan, in order to reduce the thickness of the blade to increase the number of blades and improve the fan characteristics, the blade made of plastic injection is replaced by a thin metal blade. However, limited in the manner of current metal blades combining with the hub, the effect of such replacement is limited.

Specifically, the current metal blade and the hub are mostly fixed by covering and ejecting, in which the height and thickness of the rotor are small, the structural strength of the plastic coating is insufficient, and the metal blade is easily deformed and detached. In addition, because of the need for the mold to be coated, there must be a certain distance between the metals, so that the number of blades is limited. The number of blades cannot be maximized. The coating injection needs an additional circle of plastic structure, so that the hub increases in the diameter but not the corresponding number of blades. If the automatic assembly is carried out by the coating injection, since the metal blade is less elastic in design, it can only be designed as a straight line near the hub. In order to increase the strength of the engagement, a specific length must be reserved, so that the fan size is limited again. In brief, the structural strength, matching shape and blade clearance of the fan finished in manner of coating injection with the conventional metal blades and the hub are limited. It is difficult to improve the performance or adjust to meet the practical demands.

In actual manufacturing, there are two main assembly processes of the fan with the metal blade and the plastic-covered hub. One is to clamp the full circle of blades with a jig, and the other is to use a fixture that has a groove corresponding to each blade. Regardless of the way the assembly is performed, the thickness corresponding to the clamp of the jig or the blade gap of the fixture must be reserved, so that the number of blades is difficult to be increased. For example, when the fan has 30 metal blades, it is necessary to reserve the thickness of 30 clamps or 30 blade gaps, so that the number of blades is limited.

In this regard, the conventional fan is partially welded to the metal blade and the hub, but these techniques are firstly clamp or bite the metal blade with the hub and then increase the strength by spot-welding. The substantially main connection is still fixed through clamping or engaging. For example, in Taiwanese patent application TW 1612223, a fan in which the rear end 1112 of the blade 111 is embedded in the embedding groove 1135 and then welded is disclosed. It can be seen that the number of blades is indeed limited by the reserved space.

Therefore, how to develop a fan that can effectively ensure quality, characteristics and longevity is a problem that has yet to be solved.

Therefore, there is a need of providing an improved fan that can effectively ensure quality, characteristics and lifetime in order to solve the above drawbacks.

SUMMARY OF THE INVENTION

Some embodiments of the present invention are to provide a fan in order to overcome at least one of the above-mentioned drawbacks encountered by the prior arts.

The present invention provides a fan. By directly welding the hub and the bent portion of the fan blade, there is no need to clamp or bite first, so that the fan is not limited by the size of the jig or the fixture. In condition of the same size of hub, the number of fan blades is maximized, the strength is simultaneously ensured to be enough, and the advantages of making the rotational speed faster, making the wind volume larger, making the noise quieter and effectively enhancing the fan characteristics are achieved.

The present invention also provides a fan. Since the metal blade is designed for matching the metal hub, the combining strength of the blades are effectively enhanced, and the appropriate metal blades and the number of the metal blades are applied according to the flow field design, such that the quality, the characteristics and the lifetime of the fan is ensured.

In accordance with an aspect of the present invention, there is provided a fan. The fan includes a hub and a plurality of fan blades. The hub has an axle center. The fan blades are disposed around the hub. Each of the fan blades has a bent portion, and the bent portions of the fan blades are extended along a surrounding direction surrounding the axle center. The hub is welded with the bent portion of each of the fan blades along the surrounding direction.

In accordance with another aspect of the present invention, there is provided a fan. The fan includes a hub and a plurality of fan blades. The hub has an annular sidewall. The fan blades are arranged around the annular sidewall. Each of the fan blades has a bent portion, the bent portion is extended circumferentially along the annular sidewall, and the annular sidewall of the hub is welded with the bent portion of each of the fan blades.

In accordance with another aspect of the present invention, there is provided a fan. The fan includes a hub and a plurality of fan blades. The hub has an axle center. The fan blades are surrounding the axle center. Each of the fan blades has a bent portion, and the bent portion is extended along an outer circumference of the hub. The hub is welded with the bent portion of each of the fan blades on the outer circumference of the hub.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
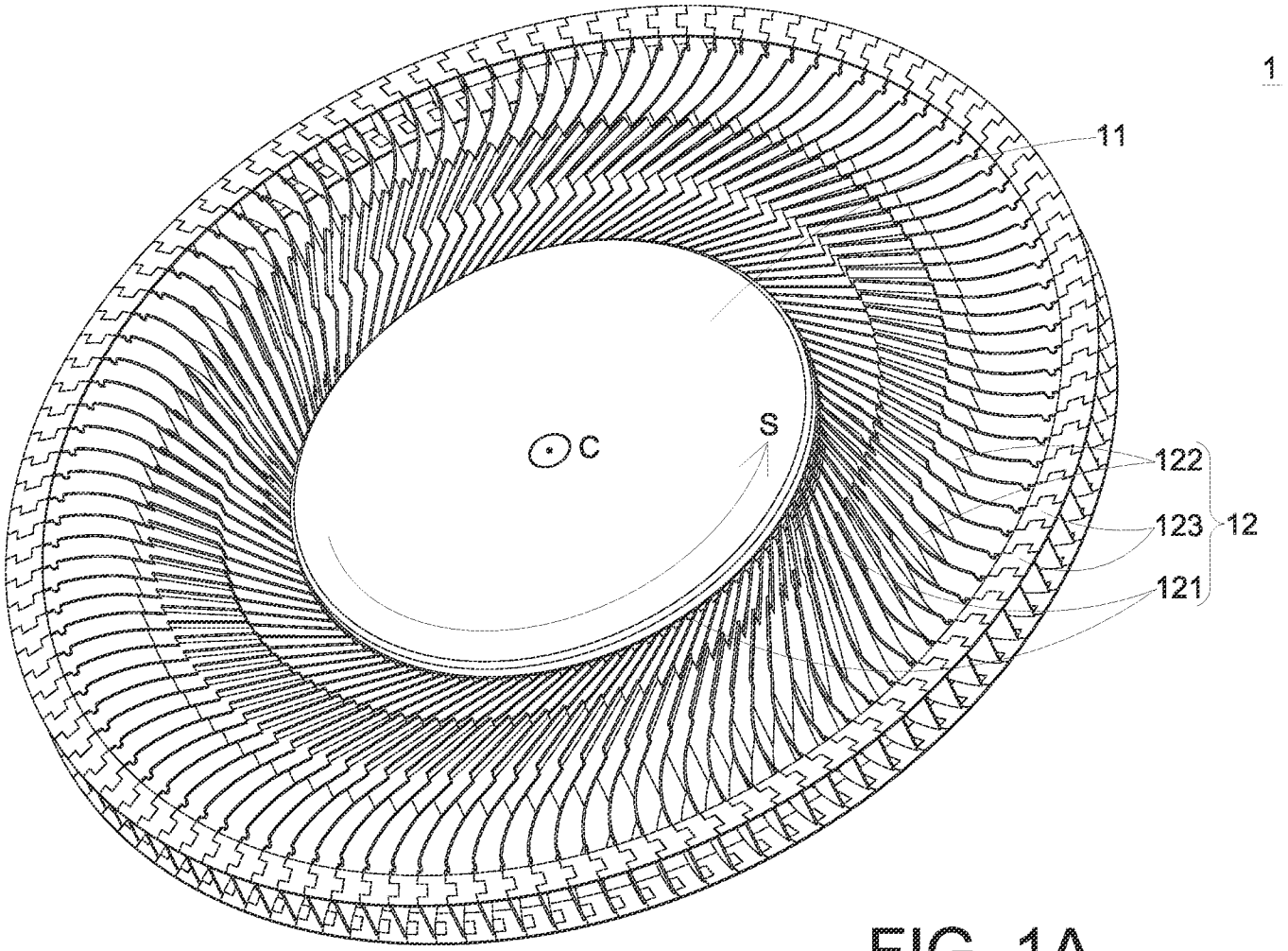
FIG. 1A schematically illustrates the structure of a fan according to an embodiment of the present invention.
Figure 1B:
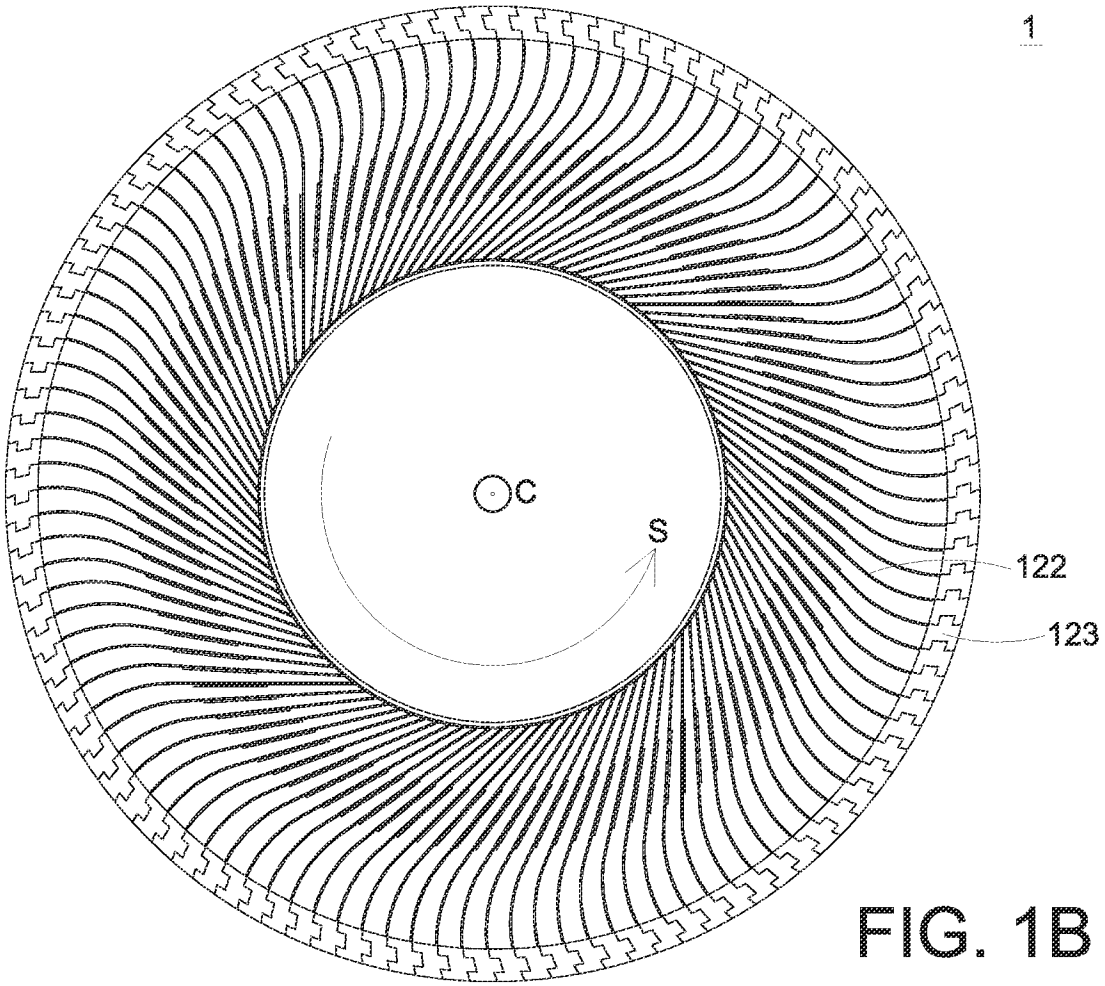
FIG. 1B schematically illustrates the top view of the fan shown in FIG. 1A.
Figure 1C:
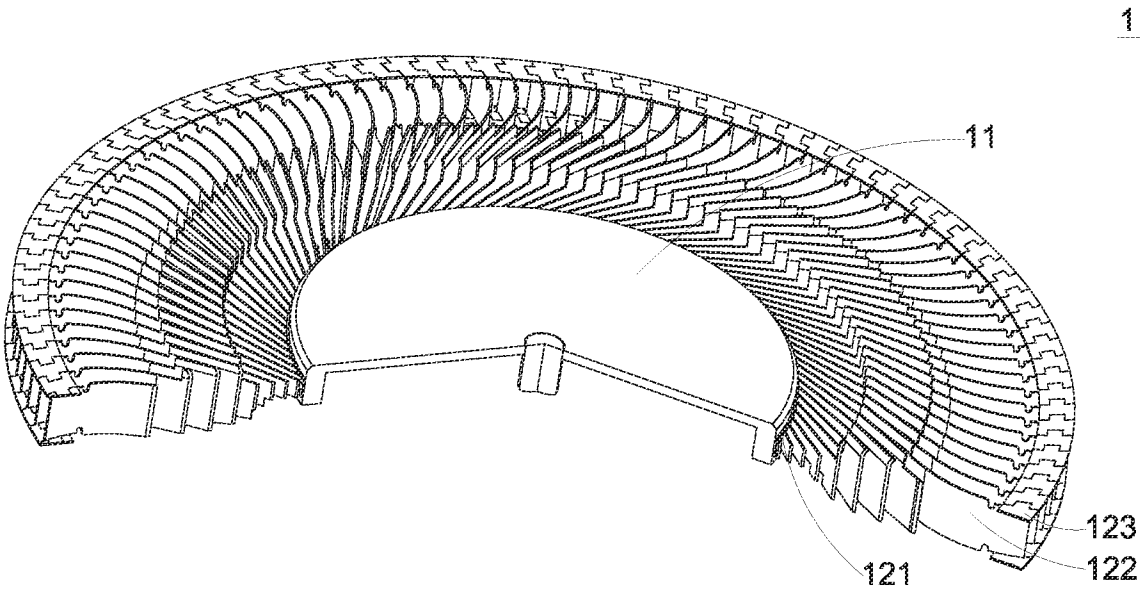
FIG. 1C schematically illustrates the partial structure of the fan shown in FIG. 1A.
Figure 1D:
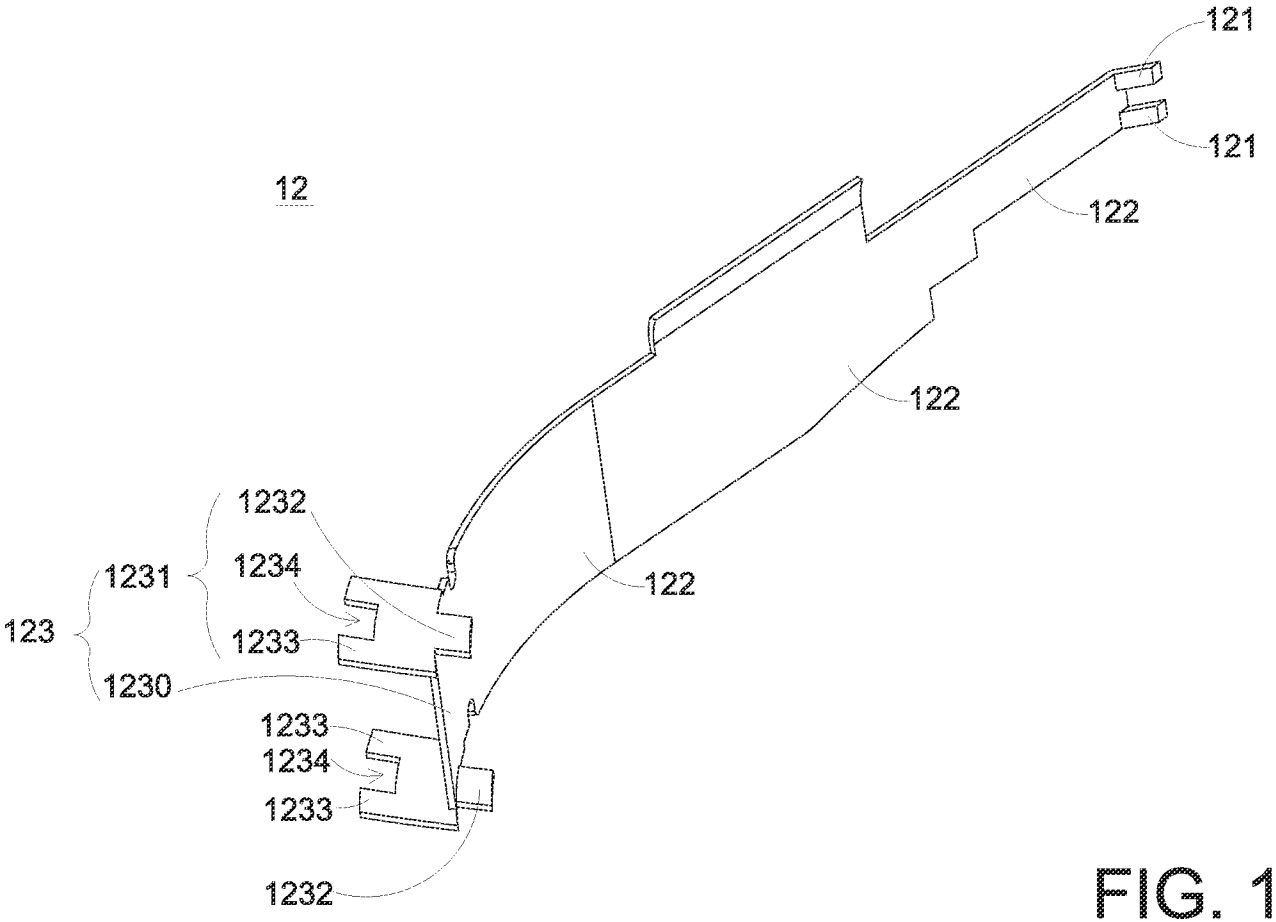
FIG. 1D schematically illustrates the detailed structure of the fan blade of the fan shown in FIG. 1A.

Please refer to FIGS. 1A to 1D. FIG. 1A schematically illustrates the structure of a fan according to an embodiment of the present invention. FIG. 1B schematically illustrates the top view of the fan shown in FIG. 1A. FIG. 1C schematically illustrates the partial structure of the fan shown in FIG. 1A. FIG. 1D schematically illustrates the detailed structure of the fan blade of the fan shown in FIG. 1A. As shown in FIGS. 1A-1D, according to an embodiment of the present invention, a fan 1 includes a hub 11 and a plurality of fan blades 12. The hub 11 has an axle center C. The fan blades 12 are disposed around the hub 11. The fan blades 12 can be considered as being arranged around the axle center C, but not limited thereto. Each of the fan blades 12 has a bent portion 121, and the bent portions 121 of the fan blades 12 are extended along a surrounding direction S surrounding the axle center C. The hub 11 is welded with the bent portion 121 of each of the fan blades 12 along the surrounding direction S. In this embodiment, the surrounding direction S is a counter-clockwise direction surrounding an outer circumference of any concentric circle centered on the axle center C. Certainly, the surrounding direction S can be a clockwise direction surrounding an outer circumference of any concentric circle centered on the axle center C. In other words, the bent portion 121 can be considered as being extended along an outer circumference of the hub 11, and the hub 11 is welded with the bent portion 121 of each of the fan blades 12 on the outer circumference of the hub 11.

In the present application, the hub 11 of the fan 1 is directly welded with the fan blades 12 and is preferred to be welded through laser line-welding. In addition, the line-welding is preferred to form a welding line around the axle center C, or to form a complete circle of welding line on the hub 11, but not limited thereto. Furthermore, it is no need for the present application to preserve the space for covering of injection. In condition of the same outer diameter of hub 11, the number of fan blades 12 can be maximized. The process of fan assembling is easy, and the iron housing and the axle tube of the hub 11 can be one-piece formed. Not only the process of manufacturing is simplified, but also the advantages of increasing the product accuracy and yield is achieved. In some embodiments, if assuming the length of the outer diameter of the hub 11 as D, the number of the fan blades 12 is preferred to be in a range between $\pi D$ to $2\pi D$. That is, the hub has an outer diameter, a number of the fan blades is larger than or equal to a product of mathematical constant $\pi$ multiplied by length D of the outer diameter, and is less than or equal to two times of the product of mathematical constant t multiplied by length D of the outer diameter.

Figure 2A:
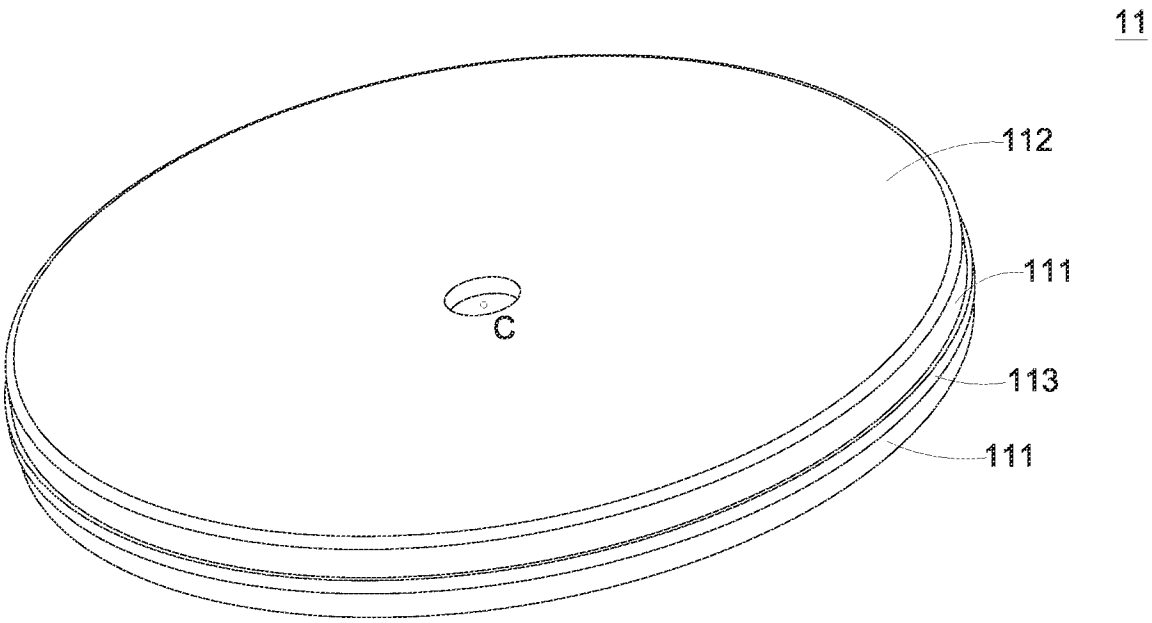
FIG. 2A schematically illustrates the structure of a hub of a fan according to an embodiment of the present invention.
Figure 2B:
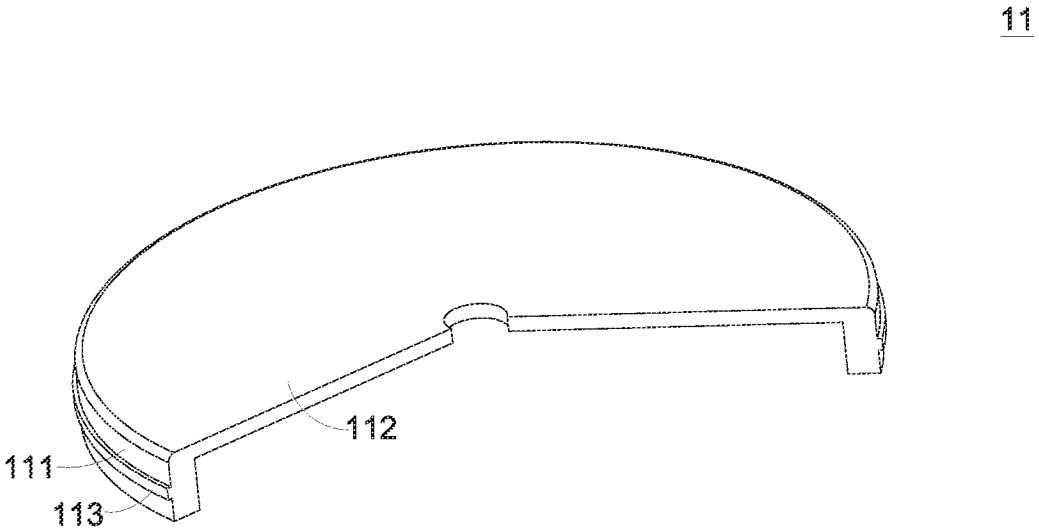
FIG. 2B schematically illustrates the partial structure of the hub shown in FIG. 2A.

Please refer to FIG. 1A, FIG. 2A and FIG. 2B. FIG. 2A schematically illustrates the structure of a hub of a fan according to an embodiment of the present invention. FIG. 2B schematically illustrates the partial structure of the hub shown in FIG. 2A. As shown in FIG. 1A, FIG. 2A and FIG. 2B, the hub 11 of the fan 1 includes an annular sidewall 111 and a top face 112. The axle center C is surrounded by the annular sidewall 111. The top face 112 is surrounded by the annular sidewall 111 and connected with the annular sidewall 111, and the top face 112 is perpendicular to the annular sidewall 111. In addition, the bent portion 121 of each of the fan blades 12 is welded with the annular sidewall 111 of the hub 11 along the surrounding direction S through laser line-welding. In this embodiment, the hub 11 may further include an annular protrusion portion 113, and the annular protrusion portion 113 is extended from the annular sidewall 111. Additionally, the plurality of fan blades 12 of the fan 1 can be considered as being arranged around the annular sidewall 111, and the bent portion 121 of the fan blade 12 can be considered as being extended circumferentially along the annular sidewall 111.

Please refer to FIG. 1D, FIG. 2A and FIG. 2B. As shown in FIG. 1D, FIG. 2A and FIG. 2B, each of the fan blades 12 further has a blade portion 122 and a blade-end portion 123, and the bent portion 121 and the blade-end portion 123 are respectively formed on two opposite ends of the blade portion 122. On each of the fan blades 12, the bent portion 121 is closest to the hub 11, and the blade-end portion 123 is farthest from the hub 11. In this embodiment, each of the bent portions 121 is two opposite cylinders or two opposite sheets, and the two opposite cylinders or sheets are connected with the annular protrusion portion 113 from two sides of the annular protrusion portion 113, and the welding between the bent portion 112 and the hub 11 is preferably implemented at the interface of the side edge of the bent portion 121 and the annular sidewall 111 of the hub 11.

In some embodiments, the blade-end portion 123 of each the fan blade 12 of the fan 1 may have a connection end portion 1230 and a buckle part 1231. The connection end portion 1230 is extended from the blade portion 122, and the buckle part 1231 is not parallel to the connection end portion 1230. The buckle part 1231 is preferably perpendicular to the connection end portion 1230. A first protrusion portion 1232 and two second protrusion portions 1233 are respectively protruded from two opposite side edges of the buckle part 1230 toward two opposite directions. A notch portion 1234 is formed between the two second protrusion portions 1233, the notch portion 1234 and the first protrusion portion 1232 are respectively located on the same position of the two opposite side edges of the connection end portion 1230, and the notch portion 1234 is preferably matched with the first protrusion portion 1232. In this embodiment, each fan blade 12 is jointed with the adjacent fan blade 12 through the connection end portion 1230. It should be noted that the joint described herein is for positioning. The fan blades 12 are fixed with the adjacent one or merely positioned with the adjacent one but not fixed in this manner of jointing.

Figure 3A:
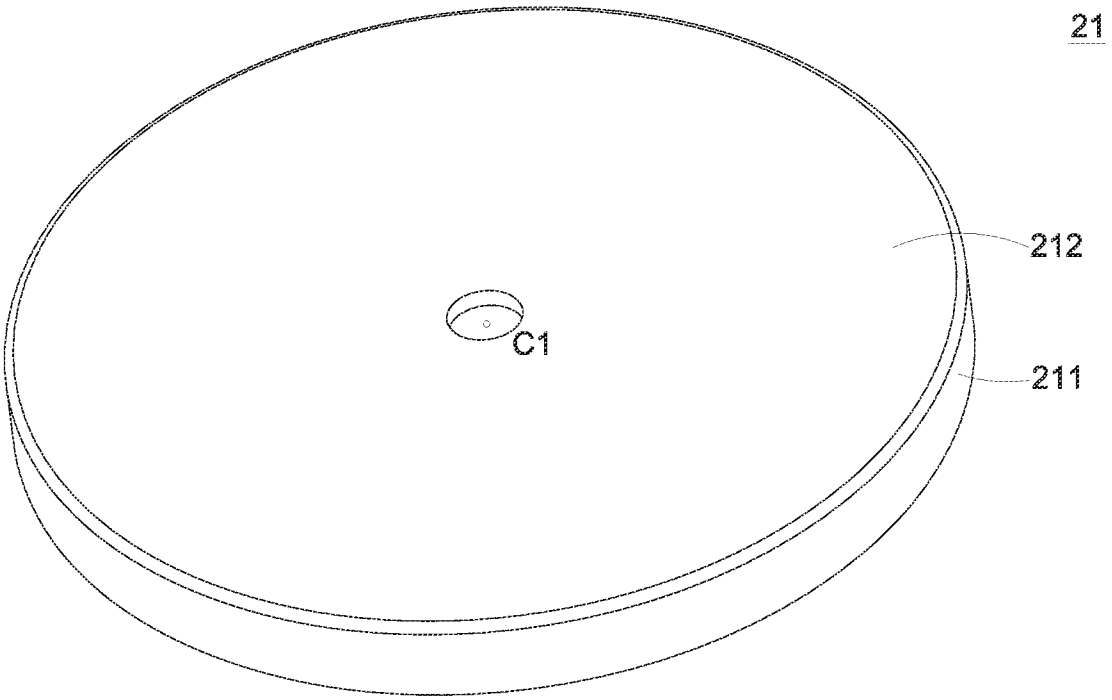
FIG. 3A schematically illustrates the structure of a hub of a fan according to another embodiment of the present invention.
Figure 3B:
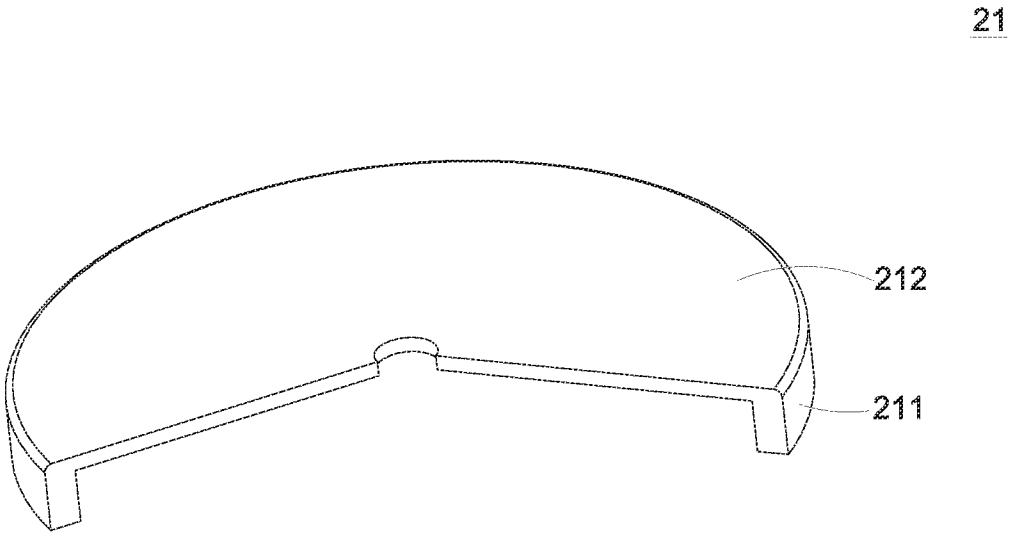
FIG. 3B schematically illustrates the partial structure of the hub shown in FIG. 3A.

Please refer to FIG. 3A and FIG. 3B. FIG. 3A schematically illustrates the structure of a hub of a fan according to another embodiment of the present invention. FIG. 3B schematically illustrates the partial structure of the hub shown in FIG. 3A. As shown in FIG. 3A and FIG. 3B, another hub 21 can be chosen in the fan of the present invention. The hub 21 has an annular sidewall 211 and a top face 212. The annular sidewall 211 surrounds the top face 212 and connects with the top face 212, and the annular sidewall 211 preferably surrounds an axle center C1. The top face 212 is preferably perpendicular to the annular sidewall 211. In this embodiment, none of a protrusion structure is formed on the annular sidewall 211.

Figure 4A:
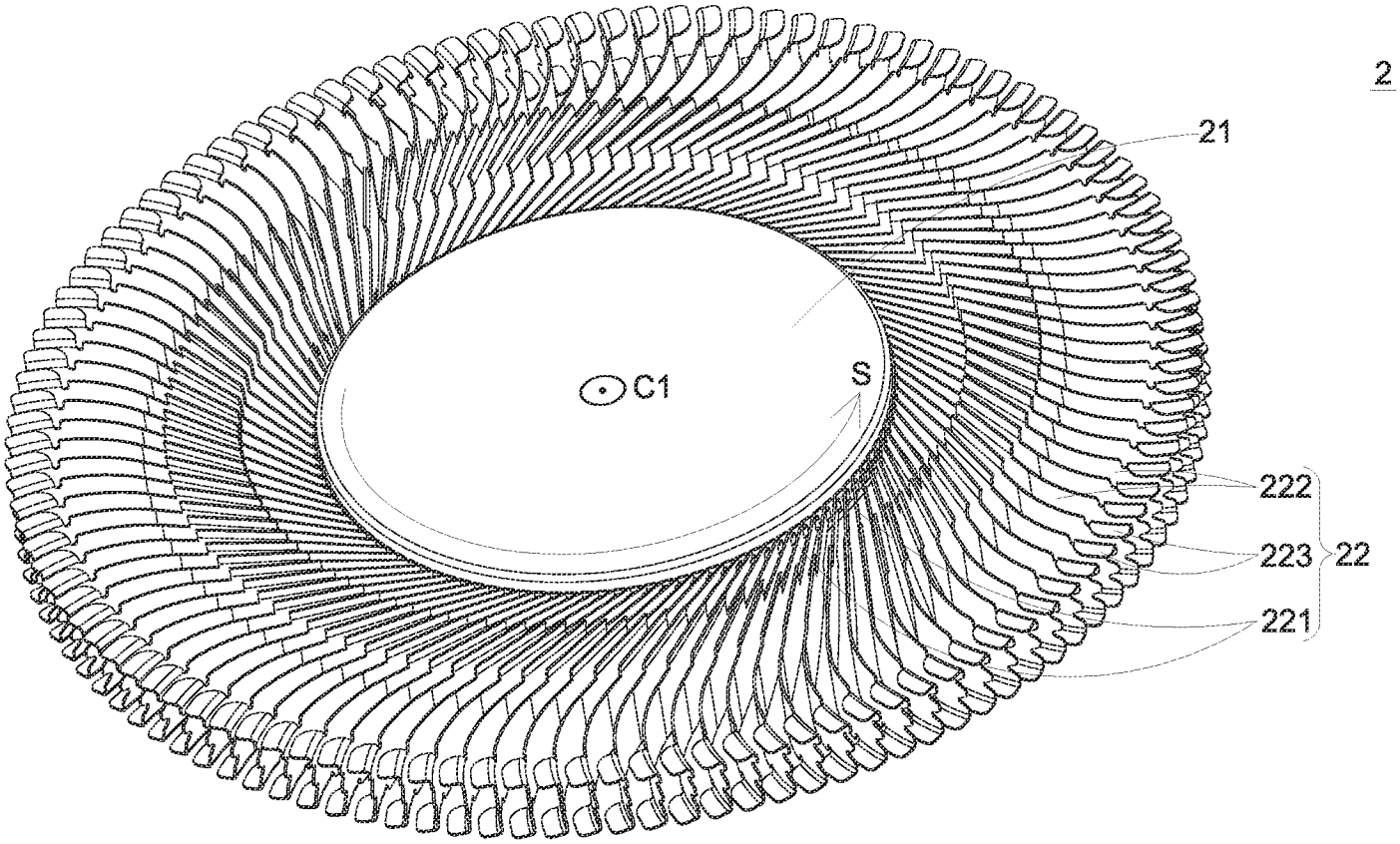
FIG. 4A schematically illustrates the structure of a fan according to another embodiment of the present invention.
Figure 4B:
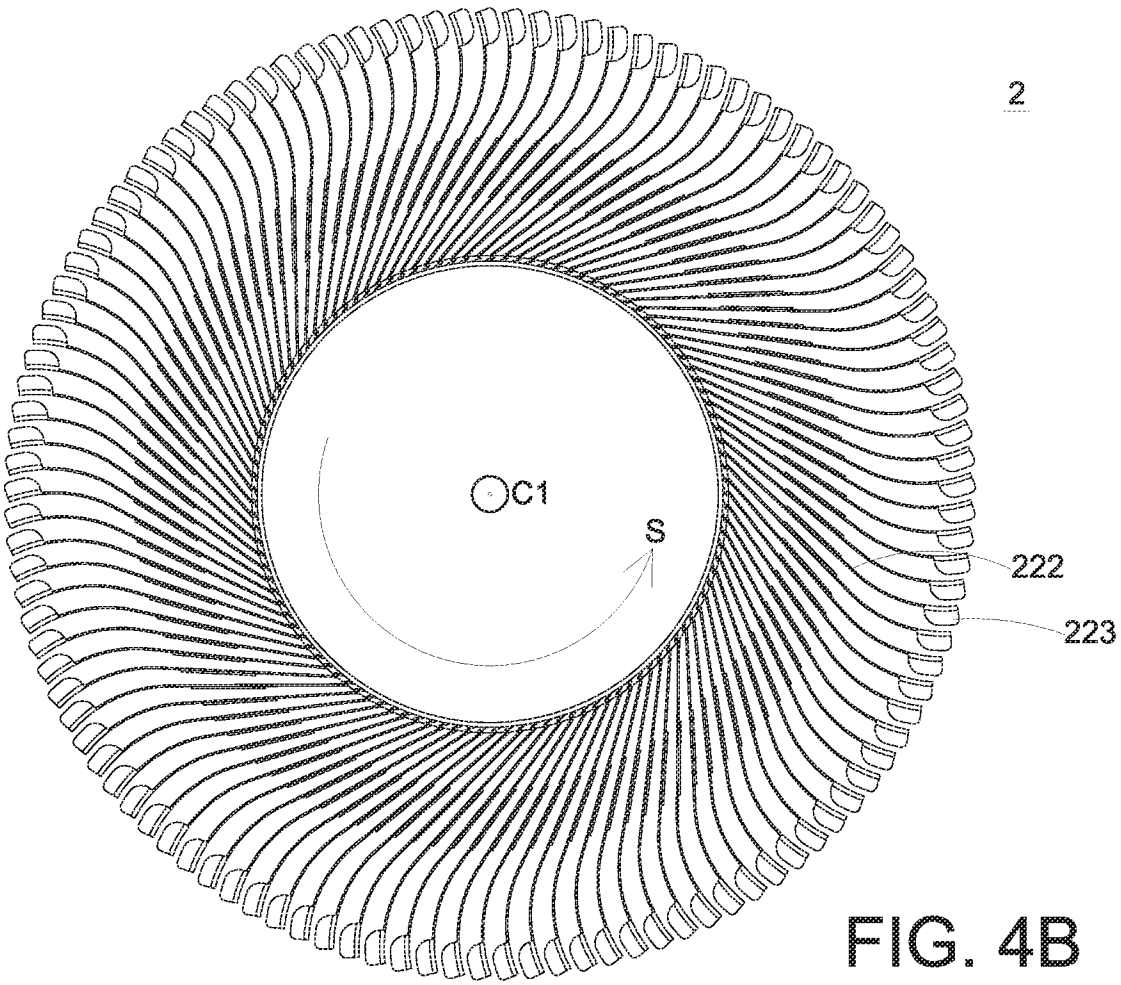
FIG. 4B schematically illustrates the top view of the fan shown in FIG. 4A.
Figure 4C:
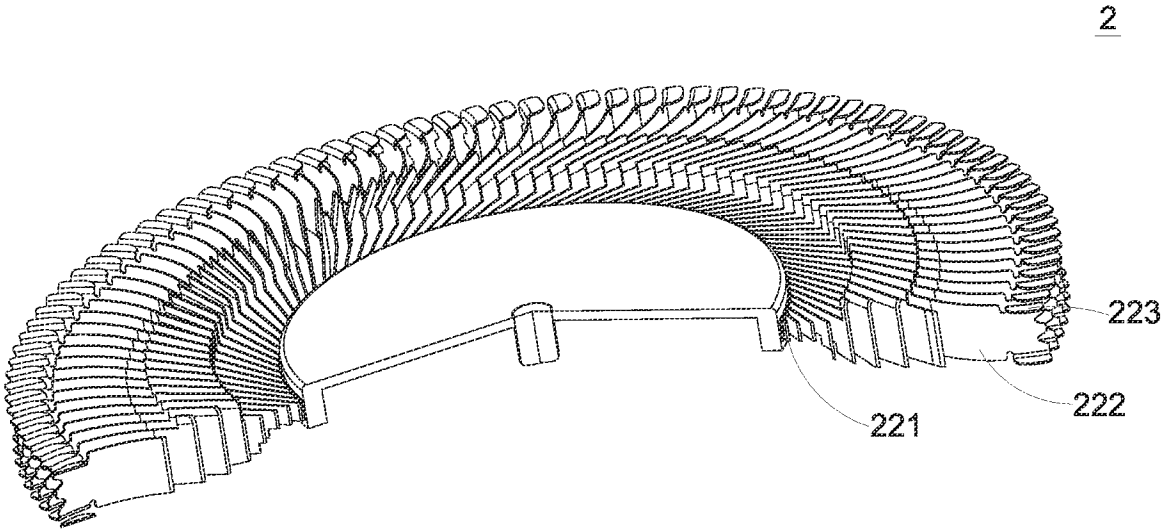
FIG. 4C schematically illustrates the partial structure of the fan shown in FIG. 4A.
Figure 4D:
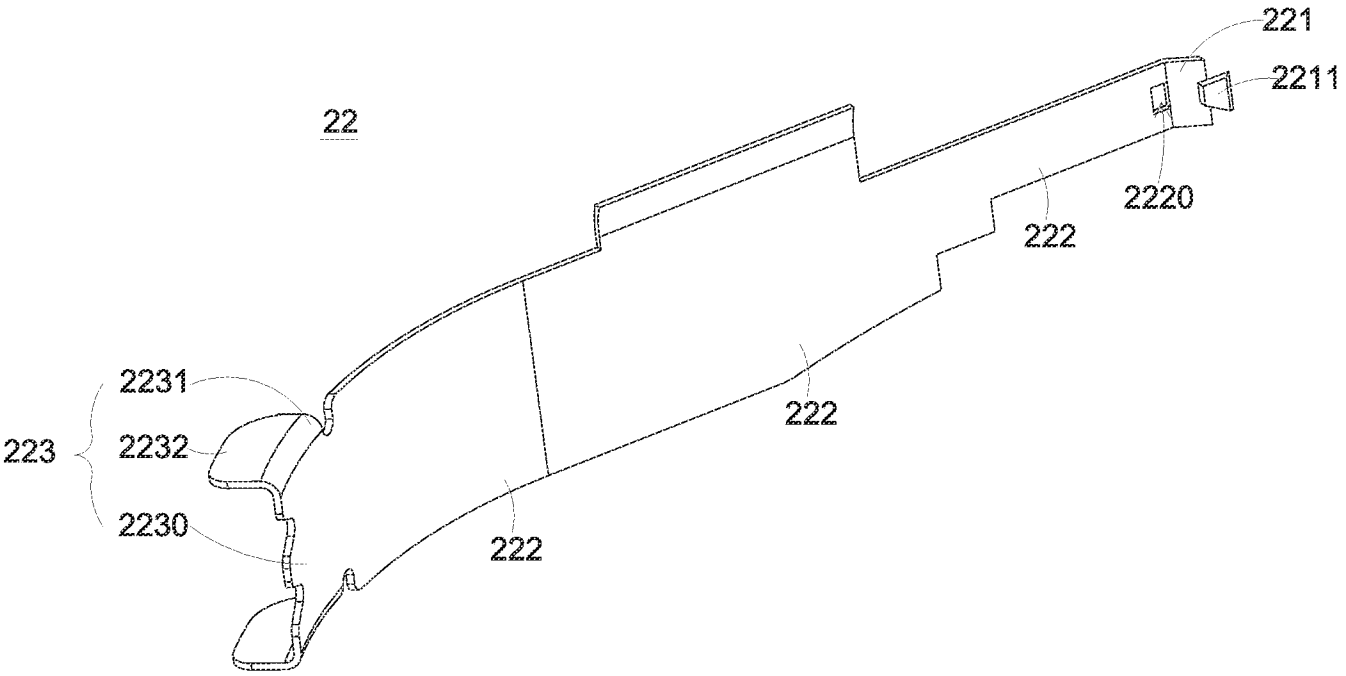
FIG. 4D schematically illustrates the detailed structure of the fan blade of the fan shown in FIG. 4A.

A fan according to another embodiment is going to be described below. The hub 21 shown in FIG. 3A and FIG. 3B can be selected. Please refer to FIGS. 4A to 4D. FIG. 4A schematically illustrates the structure of a fan according to another embodiment of the present invention. FIG. 4B schematically illustrates the top view of the fan shown in FIG. 4A. FIG. 4C schematically illustrates the partial structure of the fan shown in FIG. 4A. FIG. 4D schematically illustrates the detailed structure of the fan blade of the fan shown in FIG. 4A. As shown in FIGS. 3A-4D, according to an embodiment of the present application, a fan 2 has a hub 21 and a plurality of fan blades 22. The hub 21 has an axle center C1 and an annular sidewall 211. The fan blades 22 are arranged around the annular sidewall 211. Each fan blade 22 has a bent portion 221, a blade portion 222 and a blade-end portion 223. The bent portion 221 is extended circumferentially along the annular sidewall 211, and the annular sidewall 211 of the hub 21 is welded with the bent portion 221 of each of the fan blades 22.

Please refer to FIG. 3A, FIG. 3B and FIG. 4D. As shown in FIG. 3A, FIG. 3B and FIG. 4D, the bent portion 221 of each of the fan blades 22 of the fan 2 is formed by bending a part of the blade portion 222, the bending angle is preferably matched with the outer circumference of the annular sidewall 211 of the hub 21, but not limited thereto. In other words, the bent portion 221 faces to and substantially flat on the annular sidewall 211, and the bending angle can be varied according to the number of the fan blades and the angle of the annular sidewall 211. The blade portion 222 has an opening 2220, the opening 2220 is formed adjacent to the bent portion 221, and the bent portion 221 has an engaging portion 2211. In addition, the engaging portion 2211 of the bent portion 221 of each of the fan blades 22 is penetrated through the opening 2220 of the blade portion 222 of another adjacent fan blade 22 of the fan blades 22, so that the fan blades may be jointed with adjacent one. It should be noted that the joint described herein is for positioning. The fan blades 22 are fixed with the adjacent one or merely positioned with the adjacent one but not fixed in this manner of jointing. In this embodiment, the fan blades 22 are engaged with one adjacent fan blade 22 at the blade head (i.e. the position of the bent portion 221), and an isolating distance is between a blade-end portion 223 and a blade-end portion 223 of an adjacent fan blade 22, so that the blade portion 222 and the blade-end portion 223 of a single fan blade 22 is not contacted with the blade portion 222 and the blade-end portion 223 of an adjacent fan blade 22. In some embodiments, the engaging portion 2211 is an isosceles trapezoidal sheet body. The length of the base of the engaging portion 2211 is larger than the length of the opening 2220. That is, when the engaging portion 2211 is penetrated through the opening 2220, not only the situation of being taken out of the opening 2220 can be avoided, but also some exercise elasticity is reserved. In addition, the engaging portion 2211 can also be a structure having different sizes at both ends.

In some embodiments, the blade-end portion 223 has a connection end portion 2230, a bent part 2231 and an extended part 2232, the connection end portion 2230 is extended from the blade portion 222, the bent part 2231 is connected with the connection end portion 2230 and the extended part 2232 and bent corresponding to the connection end portion 2230, and the extended part 2232 is perpendicular to the connection end portion 2230 or not parallel to the connection end portion 2230, but not limited thereto.

Figure 5A:
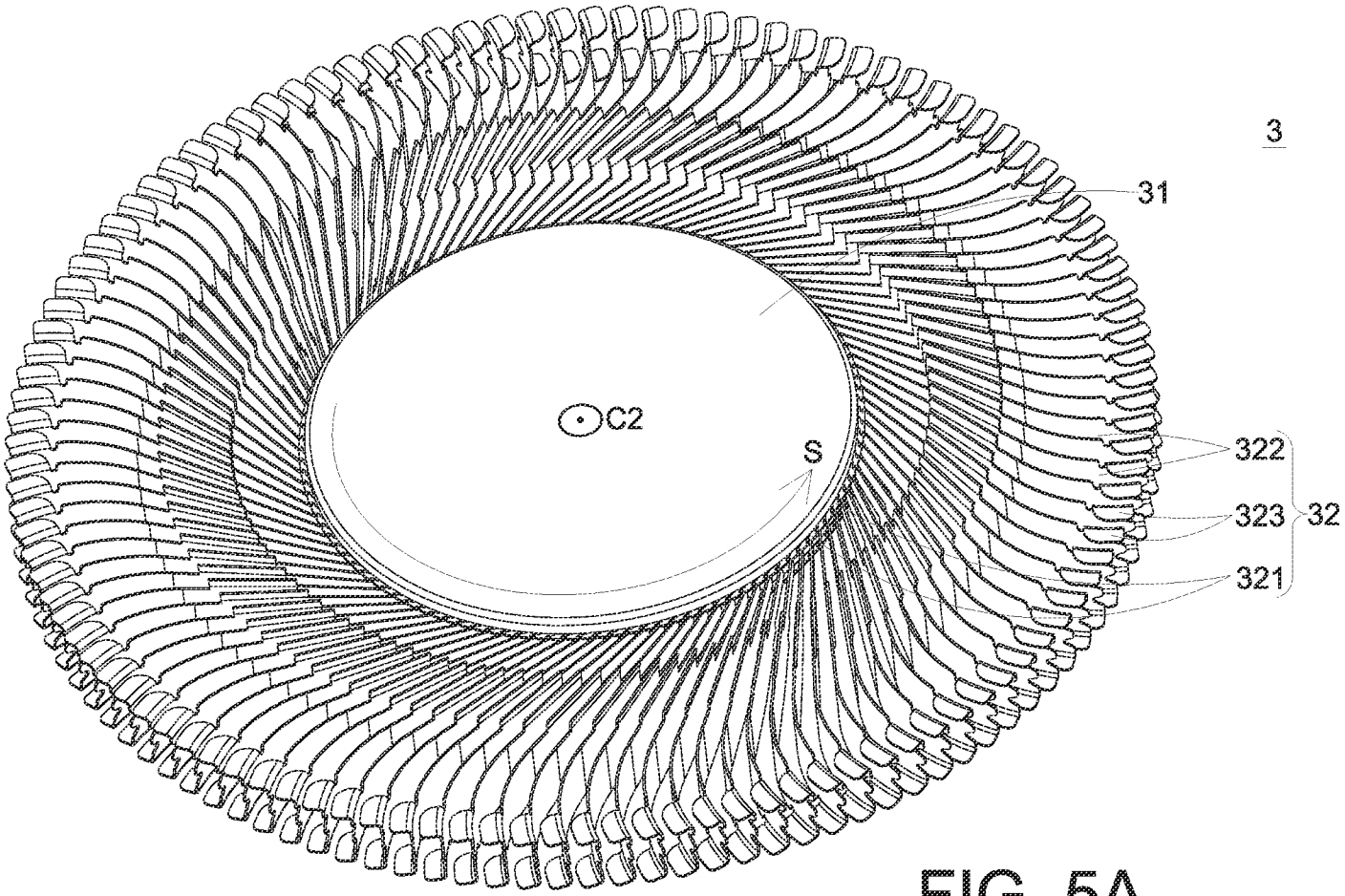
FIG. 5A schematically illustrates the structure of a fan according to another embodiment of the present invention.
Figure 5B:
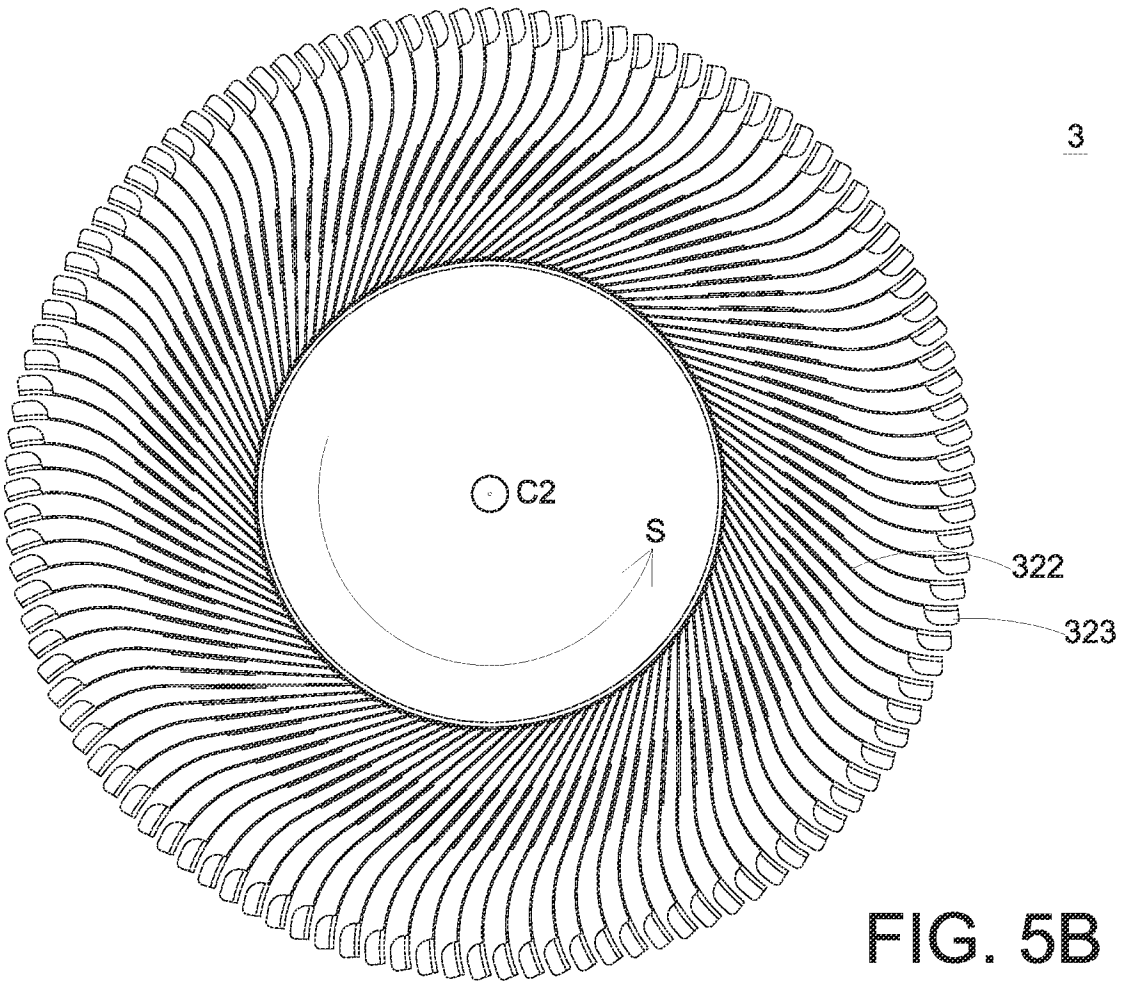
FIG. 5B schematically illustrates the top view of the fan shown in FIG. 5A.
Figure 5C:
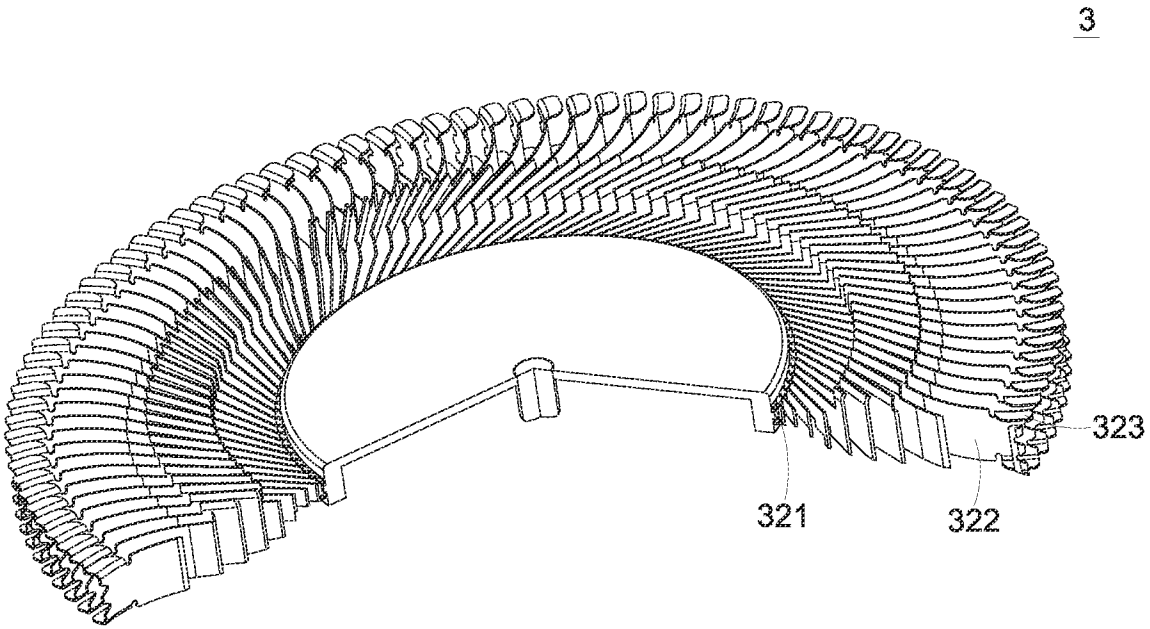
FIG. 5C schematically illustrates the partial structure of the fan shown in FIG. 5A.
Figure 5D:
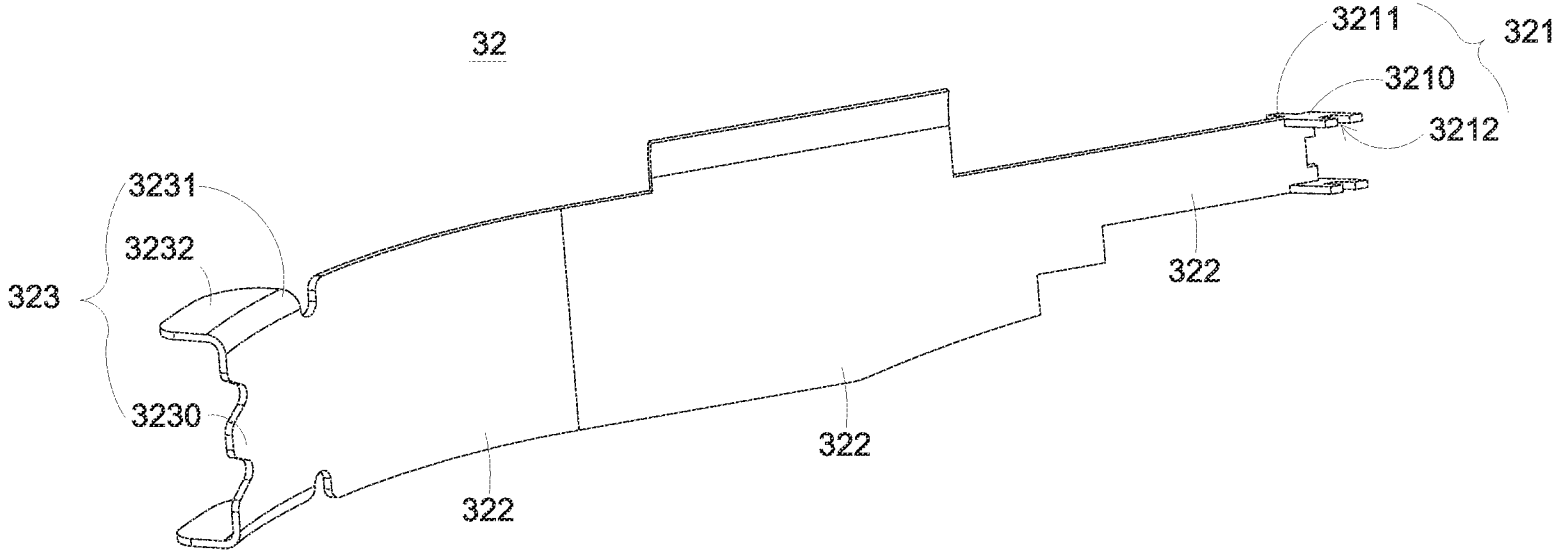
FIG. 5D schematically illustrates the detailed structure of the fan blade of the fan shown in FIG. 5A.

Please refer to FIGS. 5A to 5D. FIG. 5A schematically illustrates the structure of a fan according to another embodiment of the present invention. FIG. 5B schematically illustrates the top view of the fan shown in FIG. 5A. FIG. 5C schematically illustrates the partial structure of the fan shown in FIG. 5A. FIG. 5D schematically illustrates the detailed structure of the fan blade of the fan shown in FIG. 5A. As shown in FIGS. 5A-5D, according to an embodiment of the present invention, a fan 3 includes a hub 31 and a plurality of fan blades 32. The hub 31 has an axle center C2, and the fan blades surround the axle center C2. Each of the fan blades 32 has a bent portion 321, a blade portion 322 and a blade-end portion 323, and the bent portion 321 is extended along an outer circumference of the hub 31, and the hub 31 is welded with the bent portion 321 of each of the fan blades 32 on the outer circumference of the hub 31.

Please refer to FIGS. 2A-3B and FIG. 5D. In the present application, the hub 31 of the fan 3 may select the hub 11 shown in FIG. 2A and FIG. 2B for replacement. In some embodiments, each of the fan blades 32 further has a blade portion 322. The bent portion 321, which is two positioning sheets 3210 opposite to and parallel with each other, is formed by bending a part of the blade portion 322, and the two positioning sheets 3210 are perpendicular to the blade portion 322 and connected with the annular protrusion portion 113 from two sides of the annular protrusion portion 113. Certainly, the hub 31 of the fan 3 may select the hub 21 shown in FIG. 3A and FIG. 3B for replacement. It should be noted that the two positioning sheets 3210 are perpendicular to the blade portion 322 and respectively connected with the annular sidewall 211 from the two sides of the annular sidewall 211.

On the other hand, each of the positioning sheets 3210 has a positioning block 3211 and a positioning groove 3212, and the positioning block 3211 of the positioning sheet 3210 of each of the fan blades 32 is matched with the positioning groove 3212 of the positioning sheet 3210 of adjacent the fan blade 32. In this embodiment, the fan blades 32 are jointed to one adjacent fan blade 32 at the blade head (i.e. the position of the bent portion 321). Similarly, the joint described herein is for positioning. The fan blades 32 are fixed with the adjacent one or merely positioned with the adjacent one but not fixed in this manner of jointing.

In some embodiments, the blade-end portion 323 has a connection end portion 3230, a bent part 3231 and an extended part 3232. The connection end portion 3230 is extended from the blade portion 322. The bent part 3231 is connected with the connection end portion 3230 and the extended part 3232 and bent corresponding to the connection end portion 3230, and the extended part 3232 is perpendicular to the connection end portion 3230, but not limited thereto.

From the above discussion, the present invention provides a fan. By directly welding the hub and the bent portion of the fan blade, there is no need to clamp or bite first, so that the fan is not limited by the size of the jig or the fixture. In condition of the same size of hub, the number of fan blades is maximized, the strength is simultaneously ensured to be enough, and the advantages of making the rotational speed faster, making the wind volume larger, making the noise quieter and effectively enhancing the fan characteristics are achieved. Meanwhile, since the metal blade is designed for matching the metal hub, the combining strength of the blades are effectively enhanced, and the appropriate metal blades and the number of the metal blades are applied according to the flow field design, such that the quality, the characteristics and the lifetime of the fan is ensured.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fan, comprising:

a hub having an axle center, an annular sidewall surrounding the axle center, and an annular protrusion portion extended from the annular sidewall; and a plurality of fan blades disposed around the hub, wherein each of the fan blades has a bent portion, and the bent portions of the fan blades are extended along a surrounding direction surrounding the axle center, wherein each of the fan blades further has a blade portion, each of the bent portions of the respective fan blades is two positioning sheets opposite to and parallel with each other and is formed by bending a part of the blade portion of each of the fan blades, and the two positioning sheets are perpendicular to the blade portion and connected with the annular protrusion portion from two sides of the annular protrusion portion, and the hub is welded with the bent portion of each of the fan blades along the surrounding direction.

2. The fan according to claim 1, wherein the hub has an outer diameter, a number of the fan blades is larger than or equal to a product of mathematical constant $\pi$ multiplied by a length of the outer diameter, and is less than or equal to two times of the product of mathematical constant $\pi$ multiplied by the length of the outer diameter.

3. The fan according to claim 1, wherein the hub further includes a top face, the top face is surrounded by the annular sidewall and connected with the annular sidewall, and the top face is perpendicular to the annular sidewall.

4. The fan according to claim 1, wherein each of the two positioning sheets has a positioning block and a positioning groove, and the positioning block of the respective two positioning sheets of each of the fan blades is matched with the positioning groove of the respective two positioning sheets of an adjacent fan blade of the fan blades.

5. The fan according to claim 1, wherein the bent portion of each of the fan blades is welded with the annular sidewall of the hub along the surrounding direction through laser line-welding.

6. The fan according to claim 1, wherein the surrounding direction is a counter-clockwise direction surrounding an outer circumference of any concentric circle centered on the axle center.

7. The fan according to claim 1, wherein the surrounding direction is a clockwise direction surrounding an outer circumference of any concentric circle centered on the axle center.

8. The fan according to claim 1, wherein each of the fan blades further has a blade portion and a blade-end portion, and the bent portion and the blade-end portion of each of the fan blades are respectively formed on two opposite ends of the blade portion of each of the fan blades.

9. The fan according to claim 8, wherein on each of the fan blades, the bent portion of each of the fan blades is closest to the hub, and the blade-end portion of each of the fan blades is farthest from the hub.

10. The fan according to claim 8, wherein the blade-end portion of each of the fan blades has a connection end portion, a bent part and an extended part, the connection end portion is extended from the blade portion, the bent part is connected with the connection end portion and the extended part and bent corresponding to the connection end portion, and the extended part is perpendicular to the connection end portion.

* * * * *